United States Patent [19]

DiBiase et al.

[11] Patent Number: 4,615,818

[45] Date of Patent: Oct. 7, 1986

[54] HYDROGEN SULFIDE STABILIZED OIL-SOLUBLE SULFURIZED ORGANIC COMPOSITIONS

[75] Inventors: Stephen A. DiBiase, Euclid; James N. Vinci, Mayfield Hts., both of Ohio

[73] Assignee: The Lubrizol Corporation, Wickliffe, Ohio

[21] Appl. No.: 712,587

[22] Filed: Mar. 15, 1985

[51] Int. Cl.[4] ..... C10M 157/04; C10M 157/06

[52] U.S. Cl. ..... 252/47.5; 252/48.2; 252/48.6

[58] Field of Search ..... 252/47, 47.5, 50, 48.2, 252/48.6

[56] References Cited

U.S. PATENT DOCUMENTS

| | | | |
|---|---|---|---|
| Re. 27,331 | 4/1972 | Coleman | 252/47.5 |
| 2,265,851 | 12/1941 | Matheson | 252/48 |
| 2,394,536 | 2/1946 | Denison, Jr. et al. | 252/33.6 |
| 2,805,996 | 9/1957 | Deger | 252/33.6 |
| 2,947,695 | 8/1960 | Leshin et al. | 252/33.6 |
| 2,962,443 | 11/1960 | Rhodes | 252/56 |
| 2,999,813 | 9/1961 | Givens et al. | 252/33.6 |
| 3,221,056 | 11/1965 | Loutham | 260/583 |
| 3,419,614 | 12/1968 | Doss | 260/583 |
| 3,632,566 | 1/1972 | Coleman | 260/125 |
| 4,119,549 | 10/1978 | Davis | 252/45 |
| 4,119,550 | 10/1978 | Davis et al. | 252/45 |
| 4,177,153 | 12/1979 | Lowe | 252/47 |
| 4,191,659 | 3/1980 | Davis | 252/45 |
| 4,344,854 | 8/1982 | Davis et al. | 252/45 |
| 4,360,438 | 11/1982 | Rowan et al. | 252/33.6 |
| 4,409,114 | 10/1983 | Brois et al. | 252/75 |
| 4,478,604 | 10/1984 | Schnettenberg et al. | 252/50 |

*Primary Examiner*—Jacqueline V. Howard

*Attorney, Agent, or Firm*—Karl Bozicevic; Walter C. Danison, Jr.; Denis A. Polyn

[57] ABSTRACT

The hydrogen sulfide emission of oil-soluble sulfurized organic compounds is reduced by utilizing a hindered amine and optionally a carboxylic acid or acid anhydride in effective amounts.

7 Claims, No Drawings

HYDROGEN SULFIDE STABILIZED OIL-SOLUBLE SULFURIZED ORGANIC COMPOSITIONS

TECHNICAL FIELD OF THE INVENTION

The present invention relates to oil-soluble sulfurized organic, such as olefin, compounds having a hindered amine therein and optionally an acid anhydride or a carboxylic acid. The compositions have low odor and improved hydrogen sulfide stability. When a carboxylic acid, a monoester of a polycarboxylic acid, or an acid anhydride is used, the compositions also have good clarity.

BACKGROUND OF THE INVENTION

Heretofore, various organic oil-soluble sulfurized compounds including olefinic organic compounds have been prepared. For example, *Chemical Reviews* 65, 237 (1965) relates to sulfurized compositions prepared by reacting olefin such as isobutene with sulfur under various conditions. The Journal of the American Chemical Society, 60, 2452 (1938), as well as U.S. Pat. Nos. 3,221,056; 3,419,614; 4,119,550; 4,191,659 and 4,344, 854 relate to the reaction of olefins with hydrogen sulfide and elemental sulfur to form predominately mercaptans with sulfides, disulfides and higher polysulfides being formed as by-products.

U.S. Pat. No. 3,419,614 describes a process for increasing the yield of mercaptan by carrying out the reaction of the olefin with hydrogen sulfide and sulfur at high temperatures in the presence of various basic materials.

U.S. Pat. Nos. 4,119,550; 4,119,549 as well as 4,344,854 relate to the preparation of sulfurized compounds by the reaction of unsaturated olefinic compounds with a mixture of sulfur and hydrogen sulfide at superatmospheric pressures in the presence of various catalyst or according to various methods.

U.S. Pat. No. 4,360,438 relates to the use of sulfurized natural and synthetic oils as additives in lubricating compositions.

U.S. Pat. Nos. 3,632,566 and Reissue U.S. Pat. No. 27,331 discloses that Diels-Alder adducts can be sulfurized to form sulfur-containing compositions which are useful as extreme pressure and anti-wear additives in various lubricating oils.

U.S. Pat. No. 2,999,813 relates to a lubricating composition containing a sulfurized mineral oil and a polyvalent metal dithiocarbamate whereas U.S. Pat. No. 2,265,851 further relates to the use of coupling agents such as alcohols, esters, ketones and other suitable stable oxygen-containing materials.

Similarly, U.S. Pat. No. 2,394,536 relates to lubricating oil compositions containing the combination of organic sulfides and salts of diothiocarbamic acids.

U.S. Pat. No. 2,805,996 relates to the use of amine-dithiocarbamate complexes in lubricating oil compositions and U.S. Pat. No. 2,947,695 relates to utilizing mixtures of polyvalent metal dithiocarbamates in preparing oil-soluble additive compositions useful in the preparation of lubricating oils.

Although the above-identified documents generally relate to the preparation of various oil-soluble sulfurized compounds, they do not relate to hydrogen sulfide stabilization thereof.

U.S. Pat. No. 4,409,114 to Brois et al relates to hydrogen sulfide suppressant additives for functional fluids.

However, this patent relates to the use of sulfurized amine compounds which contain a metal therein.

SUMMARY OF THE INVENTION

Accordingly, it is an aspect of the present invention to provide an oil-soluble sulfurized organic composition which suppresses volatile sulfur compound emission in additive formulations, comprising an oil-soluble sulfurized organic compound, and a hindered organic amine, said hindered organic amine being soluble in said oil-soluble sulfurized organic compound.

It is a further aspect of the present invention to provide an oil-soluble sulfurized organic composition which suppresses volatile sulfur compound emission in additive formulations, comprising an oil-soluble sulfurized organic compound, a hindered organic amine, said hindered organic amine being soluble in said oil-soluble sulfurized organic composition, and at least one carboxylic acid, monoester of a polycarboxylic acid, or acid anhydride.

DETAILED DESCRIPTION OF THE PREFERRED EMBODIMENTS

According to the present invention, oil-soluble sulfurized organic compositions are improved with regard to $H_2S$ emission and also often with regard to odor. When a carboxylic acid or acid anhydride is utilized, the sulfurized organic compositions have good clarity.

The oil-soluble compositions of the present invention comprise at least one oil-soluble sulfurized organic compound. A wide variety of sulfurized organic compounds can be utilized in the present invention, and these compounds may generally be represented by the formula $$RS_xR_1 \qquad \text{(II)}$$

wherein S represents sulfur, x is a whole number having a value of from 1 to about 10, and R and $R_1$ may be the same or different organic groups. The organic groups may be hydrocarbon groups or substituted hydrocarbon groups containing alkyl, aryl, aralkyl, alkaryl, alkanoate, thiazole, imidazole, phosphorothionate, beta-ketoalkyl groups, etc. The substantially hydrocarbon groups may contain other substituents such as halogen, amino, hydroxyl, mercapto, alkoxy, aryloxy, thio, nitro, sulfonic acid, carboxylic acid, carboxylic acid ester, etc.

Specific examples of types of sulfurized compositions which are useful in the present invention include aromatic, alkyl or alkenyl sulfides and polysulfides, sulfurized olefins, sulfurized carboxylic acid esters, sulfurized ester olefins, sulfurized oil, and mixtures thereof. The preparation of such oil-soluble sulfurized compositions is described in the art.

The sulfurized organic compounds utilized in the present invention can be aromatic and alkyl sulfides such as dibenzyl sulfide, dixylyl sulfide, dicetyl sulfide, diparaffin wax sulfide and polysulfide, cracked wax oleum sulfides, etc. One method of preparing the aromatic and alkyl sulfides includes the condensation of a chlorinated hydrocarbon with an inorganic sulfide whereby the chlorine atom from each of two molecules is displaced, and the free valence from each molecule is joined to a divalent sulfur atom. Generally, the reaction is conducted in the presence of elemental sulfur.

Examples of dialkenyl sulfides are described in U.S. Pat. No. 2,446,072. These sulfides can be prepared by interacting an olefinic hydrocarbon containing from 3 to 12 carbon atoms with elemental sulfur in the presence of zinc or a similar metal generally in the form of an acid salt. Examples of sulfides of this type include 6,6'-dithiobis(5-methyl-4-nonene), 2-butenyl monosulfide and disulfide, and 2-methyl-2-butenyl monosulfide and disulfide.

The sulfurized olefins of the present invention includes sulfurized olefins prepared by the reaction of an olefin (preferably containing 2 to 6 carbon atoms) or a lower molecular weight polyolefin derived therefrom, with a sulfur-containing compound such as sulfur, sulfur monochloride, sulfur dichloride, hydrogen sulfide and combinations thereof.

The sulfurized organic compounds utilized in the compositions of the present invention can be sulfurized oils which may be prepared by treating natural or synthetic oils including mineral oils, lard oil, carboxylic acid esters derived from aliphatic alcohols and fatty acids or aliphatic carboxylic acids (e.g., myristyl oleate and oleyl oleate) sperm whale oil and synthetic sperm whale oil substitutes and synthetic unsaturated esters or glycerides. Stable sulfurized mineral lubricating oils can be obtained by heating a suitable mineral lubricating oil with from about 1 to about 5% of sulfur at a temperature above about 175° C. and preferably at about 200° to about 260° C. for several hours so as to obtain a reaction product which is substantially non-corrosive to copper. The mineral lubricating oils sulfurized in this manner may be distillate or residual oils obtained from paraffinic, naphthenic or mixed base crudes. Similarly, sulfurized fatty oils such as a sulfurized lard oil can be obtained by heating lard oil with about 10 to 15% of sulfur at a temperature of about 150° C. for a time sufficient to obtain a homogeneous product.

The sulfurized fatty acid esters which are useful in the compositions of this invention can be prepared by reacting sulfur, sulfur monochloride, and/or sulfur dichloride with an unsaturated fatty ester at elevated temperatures. Typical esters include $C_1$-$C_{20}$ alkyl esters of $C_8$-$C_{24}$ unsaturated fatty acids such as palmitoleic oleic, ricinoleic, petroselic, vaccenic, linoleic, linolenic, oleostearic, licanic, etc. Sulfurized fatty acid esters prepared from mixed unsaturated fatty acid esters such as are obtained from animal fats and vegetable oils such as tall oil, linseed oil, olive oil, castor oil, peanut oil, rape oil, fish oil, sperm oil, etc also are useful. Specific examples of the fatty esters which can be sulfurized include lauryl talate, methyl oleate, ethyl oleate, lauryl oleate, cetyl oleate, cetyl linoleate, lauryl ricinoleate, oleolinoleate, oleostearate, and alkyl glycerides.

Another class of organic sulfur-containing compounds include sulfurized aliphatic esters of an olefinic mono-dicarboxylic acid. For example, aliphatic alcohols of from 1 to 30 carbon atoms can be used to esterify monocarboxylic acids such as acrylic acid, methacrylic acid, 2,4-pentadienic acid, etc. or fumaric acid, maleic acid, muconic acid, etc. Sulfurization of these esters is conducted with elemental sulfur, sulfur monochloride and/or sulfur dichloride.

Still another class of sulfurized organic compounds can be utilized in the compositions of the invention are diestersulfides characterized by the following general formula $$-S_y[(CH_2)_xCOOR]_2 \quad \text{(III)}$$

wherein x is from about 2 to about 5; y is from 1 to about 6, preferably 1 to about 3; and R is an alkyl group having from about 4 to about 20 carbon atoms. The R group may be a straight chain or branched chain group that is large enough to maintain the solubility of the compositions of the invention in oil. Typical diesters include the butyl, amyl, hexyl, heptyl, octyl, nonyl, decyl, tridecyl, myristyl, pentadecyl, cetyl, heptadecyl, stearyl, lauryl, and eicosyl diesters of thiodialkanoic acids such as propionic, butanoic, pentanoic and hexanoic acids. Of the diester sulfides, a specific example is dilauryl, 3,3'-thiodipropionate.

Preferably, the sulfurized organic compound utilized in the compositions of the present invention comprise sulfurized olefins. For example, organic polysulfides can be prepared by the sulfochlorination of olefins containing four or more carbon atoms and further treatment with inorganic higher polysulfides according to U.S. Pat. No. 2,708,199.

In one embodiment, sulfurized olefins are produced by (1) reacting sulfur monochloride with a stoichiometric excess of a low carbon atom olefin, (2) treating the resulting product with an alkali metal sulfide in the presence of free sulfur in a mole ratio of no less than 2:1 in an alcohol-water solvent, and (3) reacting that product with an inorganic base. This procedure is described in U.S. Pat. No. 3,471,404, and the disclosure of U.S. Pat. No. 3,471,404 is hereby incorporated by reference for its discussion of this procedure for preparing sulfurized olefins and the sulfurized olefins thus produced. Generally, the olefin reactant contains from about 2 to 6 carbon atoms and examples include ethylene, propylene, butylene, isobutylene, amylene, etc. Briefly, in the first step, sulfur monochloride is reacted with from one to two moles of the olefin per mole of the sulfur monochloride, and the reaction is conducted by mixing the reactants at a temperature of from about 20° to 80° C. In the second step, the product of the first step is reacted with an alkali metal, preferably sodium sulfide, and sulfur. The mixture consists of up to about 2.2 moles of the metal sulfide per gram-atom of sulfur, and the mole ratio of alkali metal sulfide to the product of the first step is about 0.8 to about 1.2 moles of metal sulfide per mole of step (1) product. Generally, the second step is conducted in the presence of an alcohol or an alcohol-water solvent under reflux conditions. The third step of the process is the reaction between the phosphosulfurized olefin which contains from about 1 to about 3% of chlorine with an inorganic base in a water solution. Alkali metal hydroxide such as sodium hydroxide may be used. The reaction is continued until the chlorine content is reduced to below 0.5%, and this reaction is conducted at under reflux conditions for a period of from about 1 to 24 hours.

The sulfurized olefins which are useful in the compositions of the present invention also can be prepared by the reaction, under superatmospheric pressure, of olefinic compounds with a mixture of sulfur and hydrogen sulfide in the presence of a catalyst, followed by removal of low boiling materials. This procedure for preparing sulfurized compositions which are useful in the present invention is described in U.S. Pat. No. 4,191,659, the disclosure of which is hereby incorporated by reference for its description of the preparation of useful sulfurized compositions. An optional final step described in this patent is the removal of active sulfur by, for example, treatment with an alkali metal sulfide.

Other methods of preparing sulfurized olefin compounds for use in the present invention are set forth in U.S. Pat. Nos. 4,119,550 and 4,344,854 which generally relate to the reaction of saturated or unsaturated olefinic compounds with a mixture of sulfur and hydrogen sulfide under superatmospheric pressure, followed by removal of low boiling materials. These patents are accordingly hereby fully incorporated by reference for their description of the preparation of useful sulfurized olefinic compounds.

The olefinic compounds which can be sulfurized by this method and used in the compositions of this invention are diverse in nature. They contain at least one olefinic double bond, which is defined as a non-aromatic double bond; that is, one connecting two aliphatic carbon atoms. In its broadest sense, the olefin may be defined by the formula $$R^1R^2C{=}CR^3R^4 \qquad \text{(IV)}$$

wherein each of $R^1$, $R^2$, $R^3$ and $R^4$ is hydrogen or an organic group. In general, the R values in the above formula which are not hydrogen may be satisfied by such groups as $-C(R^5)_3$, $-COOR^5$, $-CON(R^5)_2$, $-COON(R^5)_4$, $-COOM$, $-CN$, $-X$, $-YR^5$ or $-Ar$, wherein:

each $R^5$ is independently hydrogen, alkyl, alkenyl, aryl, substituted alkyl, substituted alkenyl or substituted aryl, with the proviso that any two $R^5$ groups can be alkylene or substituted alkylene whereby a ring of up to about 12 carbon atoms is formed;

M is one equivalent of a metal cation (preferably Group I or II, e.g., sodium, potassium, barium, calcium);

X is halogen (e.g., chloro, bromo, or iodo);

Y is oxygen or divalent sulfur;

Ar is an aryl or substituted aryl group of up to about 12 carbon atoms.

Any two of $R^1$, $R^2$, $R^3$ and $R^4$ may also together form an alkylene or substituted alkylene group; i.e., the olefinic compound may be alicyclic.

The natures of the substituents in the substituted moieties described above are not normally critical and any such substituent is useful so long as it is or can be made compatible with lubricating environments and does not interfere under the contemplated reaction conditions. Thus, substituted compounds which are so unstable as to deleteriously decompose under the reaction conditions employed are not contemplated. However, certain substituents such as keto or aldehydo can desirably undergo sulfurization. The selection of suitable substituents is within the skill of the art or may be established through routine testing. Typical of such substituents include any of the above-listed moieties as well as hydroxy, amidine, amino, sulfonyl, sulfinyl, sulfonate, nitro, phosphate, phosphite, alkali metal mercapto and the like.

The olefinic compound is usually one in which each R value which is not hydrogen is independently alkyl, alkenyl or aryl, or (less often) a corresponding substituted group. Monoolefinic and diolefinic compounds, particularly the former, are preferred, and especially terminal monoolefinic hydrocarbons; that is, those compounds in which $R^3$ and $R^4$ are hydrogen and $R^1$ and $R^2$ are alkyl or aryl, especially alkyl (that is, the olefin is aliphatic). Olefinic compounds having about 3 to 30, desirably about 3 to 16, especially 9 or less, and preferably 8 carbon atoms are particularly desirable.

Ethylene, isobutene, propylene and oligomers thereof are especially preferred olefinic compounds. Of these compounds, isobutylene and diisobutylene are particularly desirable because of their availability and the particularly high sulfur-containing compositions which can be prepared therefrom.

Commercial sources of sulfur and hydrogen sulfide are normally used for the purpose of this sulfurization reaction, and impurities normally associated therewith may be present without adverse results. Thus, commercial diisobutene is believed to contain essentially two isomeric forms and this mixture is contemplated for use according to the present invention.

The amines used in the present invention are hindered organic amines. By the term "hindered", it is meant that the organic amine has stearic hindrance therein. The hindered organic amine is also soluble in the oil-soluble sulfurized organic compound. That is, based upon 100 parts by weight of said oil-soluble sulfurized organic compound, the solubility of the amine is at least 0.01 parts by weight, desirably at least 5.0 parts by weight, and preferably at least 10.0 parts by weight up to a large excess of said amine, as for example 10,000 parts by weight. Desirably, the organic amine compound is added in an effective amount such as to suppress volatile sulfur compound emission and/or reduce odor. Accordingly, the amount of the hindered organic amine used in the present invention can be from about 0.1 to about 20% by weight and desirably from about 0.25 to about 2.0% by weight based upon the weight of the oil-soluble sulfurized compound in the composition.

The hindered organic amine can either be a polyamine or more desirably a monoamine. The organic amine can also contain unsaturated hydrocarbon groups therein but desirably is saturated. Suitable amines include hydrocarbyl amines having from 3 to about 100 carbon atoms and preferably from 3 to about 30 carbon atoms, such as aliphatic amines, aromatic amines, or combinations thereof, e.g., aliphatic substituted aromatic amines. Desirably, the hydrocarbyl group is an alkyl group.

Desirable hindered hydrocarbyl amines according to the present invention have the formula

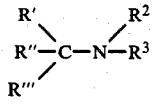

wherein R′, R″ and R‴ can be the same or different. R′, R″ and R‴ can be a hydrocarbyl such as aromatic, aliphatic, or combinations thereof, or hydrogen, but regardless of the makeup or content of any particular R′, R″, or R‴ substituent, collectively they have a total of 2 to about 30 carbon atoms. That is, at least one of the R′, R″ or R‴ substituents must contain one or two carbon atoms therein. Desirably, R′, R″ and R‴ are alkyl. a preferred total number of carbon atoms of R′, R″ and R‴ is from about 12 to about 14. Considering $R^2$ and $R^3$, they can be the same or different, and also can be hydrocarbyl or hydrogen. However, collectively they have from 0 to about 30 carbon atoms. Desirably, $R^2$ and $R^3$ are alkyl having a total of 0 to 4 carbon atoms, but preferably are both hydrogen. Thus, desirable amines of the present invention include t-octylamine, and the like. A commercially available compound is Primene JM-T which is a mixture of isomeric amines having from 18 to 22 carbon atoms or Primene 81-R which is a mixture of isomeric amines having from 12 to 14 carbon atoms. The Primene compounds are produced by the Rohm & Haas Corporation.

The oil-soluble sulfurized organic compound is often used as a metal working additive. Accordingly, the sulfurized organic compounds of the present invention in association with the hindered organic amine find common use in additive formulations. Preparation of an additive concentrate or the like containing the oil-soluble sulfurized organic compound and the hindered organic amine can utilize any conventional or common mixing or blending method as by merely adding one to the other. Usually agitation is utilized to blend or mix the components together.

It has been unexpectedly found that the use of at least one carboxylic acid or acid anhydride in combination with a hindered amine in the oil-soluble sulfurized organic compound generally yields good clarity as well as improved hydrogen sulfide stability and low or nil odor. Although monocarboxylic acids can be utilized, polycarboxylic acids are preferred. The hydrocarbon portion of the acid can be saturated or unsaturated. The acid contains at least two carbon atoms as from about 2 to about 100 carbon atoms and desirably from about 3 to about 30 carbon atoms. Examples of saturated monocarboxylic acids include acetic, propionic, butyric, lauric, palmitic, stearic, and the like. Examples of saturated dicarboxylic acids include oxalic, malonic, succinic, glutaric, adipic, pimelic, and the like. Examples of suitable unsaturated acid include acrylic acid, maleic, fumaric, and the like.

A suitable acid of the present invention is a substituted succinic acid of the formula

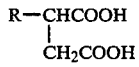

wherein R is a hydrocarbyl group having at least 10 carbon atoms. Generally R has from about 10 to about 100 carbon atoms, desirably from about 10 to about 30 carbon atoms with approximately 9 to 15 carbon atoms being preferred. The R substituent of the above set forth formula desirably is alkenyl. Moreover, it is often a low molecular weight olefinic hydrocarbon reactant such as tetrapropylene, triisobutylene, tetraisobutylene, and the like. Such low molecular weight substituents are monoolefins and have a branched chain structure. A highly preferred acid of the present invention is polypropenyl succinic acid.

Included within the definition of carboxylic acids are monoesters of polycarboxylic acids. These compounds are derived from the above polycarboxylic acids or anhydrides thereof and hence can contain the same number of carbon atoms in the acid portion as well as be saturated or unsaturated as set forth above. With regard to the monoester group, it generally has from about 1 to 100, desirably from 1 to about 30 and preferably from 1 to about 10 carbon atoms. The monoester group can also contain one or more hydroxy groups with one such hydroxy group being preferred. Accordingly, the monoester group is generally a hydrocarbyl or a hydroxyhydrocarbyl with an alkyl or a hydroxyalkyl group being preferred. A suitable monoester of a polycarboxylic acid has the formula

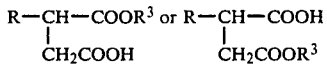

wherein R is as set forth above. That is, a hydrocarbyl group having from about 10 to about 100 carbon atoms and the like. $R^3$ is the monoester group and accordingly has from 1 to about 100, desirably from 1 to about 30 and preferably from 1 to about 10 carbon atoms. As noted, $R^3$ can be hydrocarbyl or hydroxyhydrocarbyl and preferably alkyl or hydroxyalkyl.

In combination with, or in lieu of a carboxylic acid, an acid anhydride can be utilized. The acid anhydrides are derivatives of the above-noted polycarboxylic acids. Thus, the acid anhydrides will have from about 4 to about 100 carbon atoms with from about 4 to about 30 carbon atoms being preferred. Inasmuch as the acid anhydrides are derivatives of the above-noted carboxylic acids, the description thereof will not be repeated, but is rather hereby incorporated by reference including the above-substituted succinic acid formulation. Examples of acid anhydrides include acetic anhydride, propionic anhydride, succinic anhydride, glutaric anhydride, and the like.

The relative amount of the carboxylic acid or acid anhydride to the hindered organic amine generally is important or critical. The amount of the carboxylic acid, monoester of a polycarboxylic acid, acid anhydride, or combinations thereof to the amine is generally from about 0.1 to about 20, desirably from about 0.25 to about 2.0 and preferably about 1:1 on a weight basis. The effective amount of the carboxylic acid or acid anhydride will vary somewhat depending upon the type of specific acid or anhydride, type of sulfurized compound, and the like. Usually, from about 0.1 to about 20% by weight and desirably from about 0.25 to about 2% by weight of the acid and/or anhydride based upon the total weight of the oil-soluble sulfurized organic compound is used. Typically, an amount is used such that good clarity of the oil-soluble sulfurized organic composition is obtained. Although the carboxylic acid, monoester of a polycarboxylic acid, or acid anhydride itself need not be soluble in the oil-soluble sulfurized organic compound, it, in combination with the hindered amine should be soluble in said oil-soluble sulfurized organic compound.

The preparation of the oil-soluble sulfurized organic composition containing the sulfurized organic compound, the hindered organic amine and the carboxylic acid/or acid anhydride can be by any conventional method. Often times the various components can simply be blended or mixed together at ambient temperature.

As noted, the compositions of the present invention have improved hydrogen sulfide stability, low odor, and good clarity. The compositions are especially suitable as metal working additives, as additive concentrates and the like.

The invention will be better understood by reference to the following examples.

EXAMPLES 1–7

A 40% sulfurized olefin is prepared by reacting sulfur, $H_2S$ and diisobutylene. That is, 96 grams of sulfur (3 moles) is charged to a jacketed high pressure reactor which is fitted with an agitator and internal cooling coils. Refrigerated brine is circulated through the coils to cool the reactor prior to the introduction of the gaseous reactants. After sealing the reactor, evacuating to about 2 torr and cooling, 224 grams (2 moles) of diisobutylene and 34 grams (1 mole) of hydrogen sulfide are charged to the reactor. The reactor is heated using steam in the external jacket, to a temperature of about 171° C. over about 1.5 hours. A maximum pressure of 1350 psig. is reached at about 168° C. during this heat-up. Prior to reaching the reaction temperature, the pressure starts to decrease and continues to decrease steadily as the gaseous reactants are consumed. After about 10 hours at a reaction temperature of about 171° C., the pressure is approximately 310 to about 340 psig. and the rate of pressure change is about 5 to 10 psig. per hour. The unreacted hydrogen sulfide and diisobutylene are vented to a recovery system. After the pressure of the reactor has decreased to atmospheric, the sulfurized mixture is covered as a liquid. The mixture is blown with nitrogen and then vacuum stripped to remove the low boiling materials including unreacted diisobutylene, mercaptans and monosulfides. The filtrate is the desired sulfurized composition which contains approximately 40% sulfur by weight. Various amounts of Primene 81-R was added thereto as set forth in Table IA. Primene 81-R is a tertiary-alkyl amine manufactured by Rohm & Haas Corporation and is essentially mixtures of isomeric amines containing from 12 to 14 carbon atoms. The components were mixed for a very short period of time and then tested with regard to clarity and hydrogen sulfide. Hydrogen sulfide was quantitatively determined. The results are set forth in Tables IA and IB.

TABLE IA

Vapor Space Hydrogen Sulfide Determination
Samples stored 65° C./1 week

| Sulfurized Olefin Plus | Vapor Space $H_2S$ (ppm) | Compatibility |
|---|---|---|
| 1. Nothing | 800 | Clear |
| 2. 5.0% Primene 81-R | Nil | Very hazy + suspension |
| 3. 2.5% Primene 81-R | Nil | Hazy + suspension |
| 4. 1.5% Primene 81-R | Nil | Hazy |
| 5. 1.0% Primene 81-R | Nil | Slight haze |
| 6. 0.5% Primene 81-R | Nil | Trace haze |
| 7. 0.25% Primene 81-R | 180 | Clear |

TABLE IB

Samples stored 65° C./1 month

| Sulfurized Olefin Plus | Vapor Space $H_2S$ (ppm) 65° C./1 week | 65° C./1 month |
|---|---|---|
| Nothing | 800 | 1000 |
| 1.0% Primene 81-R | Nil | 10 |
| 0.5% Primene 81-R | Nil | 20 |

As apparent from Table IA and IB, the addition of the hindered amine had a dramatic effect upon reducing the hydrogen sulfide generated over a period of one week or one month. However, the solutions did exhibit various degrees of haze.

EXAMPLES 8–13

Upon the addition of various carboxylic acids, the degree of haze was greatly reduced as set forth in Table II.

TABLE II

| | JTU @ Initial | 1 Wk/ 65° C. | 1 Mth/ 65° C. |
|---|---|---|---|
| 8. SO | 4 | 4 | 1 |
| 9. SO + 0.5% P | 7 | 120 | 210 |
| 10. SO + 0.5% P + 0.25% OA | 2 | 1 | 2 |
| 11. SO + 0.5% P + 0.5% OA | 1 | 1 | 2 |
| 12. SO + 0.5% P + 0.25% TS | 13 | 100 | 110 |
| 13. SO + 0.5% P + 0.5% TS | 1 | 1 | 1 |

SO = sulfurized olefin
P = Primene 81-R
TS = tetrapropenyl succinic acid
OA = oleic acid As apparent from Table II, the haze conditions encountered by using a hindered amine were greatly reduced. Moreover, the amount of vapor space hydrogen sulfide in all examples except Example 8 were very little or nil.

It should thus be apparent that volatile sulfur compound emission has been suppressed. The odor of Examples 2–7 and 9–13 was also reduced.

The sulfurized compositions of the invention can be effectively employed in a variety of lubricating compositions formulated for a variety of uses. These lubricating compositions are based on diverse oils of lubricating viscosity, including natural and synthetic lubricating oils and mixtures thereof. These lubricating compositions containing the subject additive concentrates are effective as crankcase lubricating oils for spark-ignited and compression-ignited internal combustion engines, including automobile and truck engines, two-cycle engines, aviation piston engines, marine and low-load diesel engines, and the like. Also, automatic transmission fluids, transaxle lubricants, gear lubricants, metal-working lubricants, hydraulic fluids, and other lubricating oil and grease compositions can benefit from the incorporation of the subject additive concentrates.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethylene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)-sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Generally the above lubricants contain an amount of one or more of the oil-soluble sulfurized compositions of this invention sufficient to provide them with improved properties. Normally the amount employed will be a minor amount such as about 0.01% to about 20%, preferably about 0.1% to about 10% of the total weight of the lubricating composition.

The invention also contemplates the use of other additives in combination with the sulfurized compositions of this invention. Such additives include, for example, detergents and dispersants of the ash-producing or ashless type, corrosion- and oxidation-inhibiting agents, pour point depressing agents, extreme pressure agents, antiwear agents, color stabilizers and anti-foam agents.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature of about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, stearyl alcohol, and cyclohexyl alcohol; and amines such as aniline, phenylenediamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°–200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the lubricant compositions of this invention. The following are illustrative:

(1) Reaction products of carboxylic acids (or derivatives thereof) containing at least about 34 and preferably at least about 54 carbon atoms with nitrogen containing compounds such as amine, organic hydroxy compounds such as phenols and alcohols, and/or basic inorganic materials. Examples of these "carboxylic dispersants" are described in British Patent No. 1,306,529 and in many U.S. patents including the following:

| | | |
|---|---|---|
| 3,163,603 | 3,351,552 | 3,541,012 |

-continued

| | | |
|---|---|---|
| 3,184,474 | 3,381,022 | 3,543,678 |
| 3,215,707 | 3,399,141 | 3,542,680 |
| 3,219,666 | 3,415,750 | 3,567,637 |
| 3,271,310 | 3,433,744 | 3,574,101 |
| 3,272,746 | 3,444,170 | 3,576,743 |
| 3,281,357 | 3,448,048 | 3,630,904 |
| 3,306,908 | 3,448,049 | 3,632,510 |
| 3,311,558 | 3,451,933 | 3,632,511 |
| 3,316,177 | 3,454,607 | 3,697,428 |
| 3,340,281 | 3,467,668 | 3,725,441 |
| 3,341,542 | 3,501,405 | 4,234,435 |
| 3,346,493 | 3,522,179 | Re 26,433 |

(2) Reaction products of relatively high molecular weight aliphatic or alicyclic halides with amines, preferably polyalkylene polyamines. These may be characterized as "amine dispersants" and examples thereof are described for example, in the following U.S. patents:

| | |
|---|---|
| 3,275,554 | 3,454,555 |
| 3,438,757 | 3,565,804 |

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. patents are illustrative:

| | | |
|---|---|---|
| 2,459,112 | 3,442,808 | 3,591,598 |
| 2,962,442 | 3,448,047 | 3,600,372 |
| 2,984,550 | 3,454,497 | 3,634,515 |
| 3,036,003 | 3,459,661 | 3,649,229 |
| 3,166,516 | 3,461,172 | 3,697,574 |
| 3,236,770 | 3,493,520 | 3,725,277 |
| 3,355,270 | 3,539,633 | 3,725,480 |
| 3,368,972 | 3,558,743 | 3,726,882 |
| 3,413,347 | 3,586,629 | 3,980,569 |

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. patents:

| | | | |
|---|---|---|---|
| 3,036,003 | 3,282,955 | 3,493,520 | 3,639,242 |
| 3,087,936 | 3,312,619 | 3,502,677 | 3,649,229 |
| 3,200,107 | 3,366,569 | 3,513,093 | 3,649,659 |
| 3,216,936 | 3,367,943 | 3,533,945 | 3,658,836 |
| 3,254,025 | 3,373,111 | 3,539,633 | 3,697,574 |
| 3,256,185 | 3,403,102 | 3,573,010 | 3,702,757 |
| 3,278,550 | 3,442,808 | 3,579,450 | 3,703,536 |
| 3,280,234 | 3,455,831 | 3,591,598 | 3,704,308 |
| 3,281,428 | 3,455,832 | 3,600,372 | 3,708,422 |

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymer dispersants" and examples thereof are disclosed in the following U.S. patents:

| | |
|---|---|
| 3,329,658 | 3,666,730 |
| 3,449,250 | 3,687,849 |
| 3,519,565 | 3,702,300 |

The above-noted patents are incorporated by reference herein for their disclosures of ashless dispersants.

Extreme pressure agents and corrosion- and oxidation-inhibiting agents which may be included in the lubricants of the invention are exemplified by chlorinated aliphatic hydrocarbons such as chlorinated wax; oganic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Many of the above-mentioned auxiliary extreme pressure agents and corrosion-oxidation inhibitors also serve as antiwear agents. Zinc dialkylphosphorodithioates are a well known example.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith (Lezius-Hiles Co. publishers, Cleveland, Ohio, 1967).

Examples of useful pour point depressants are polymethacrylates; polyacrylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

The amount of the oil-soluble sulfurized organic composition of the present invention when utilized as a concentrate is generally from about 50 to about 100% by weight and often exists as a neat composition.

While in accordance with the patent statutes, the invention has been described in detail, the scope of the present invention is set forth by the attached claims.

We claim:

1. An oil-soluble sulfurized organic composition which suppresses volatile sulfur compound emission in additive formulations, comprising:

(a) an oil-soluble sulfurized organic compound;

(b) a hindered organic amine, structured so as to provide stearic hindrance therein, said hindered organic amine being soluble in said oil-soluble sulfurized organic compound; and (c) an organic compound selected from the group consisting of carboxylic acids, monoesters of polycarboxylic acids, and acid anhydrides, wherein the organic compound (c) is present in an amount of about 0.1 to about 20% by weight based on the weight of the oil-soluble sulfurized organic compound (a), and the weight ratio of (c):(b) is in the range of about (0.1–20):1.

2. An oil-soluble sulfurized organic composition as claimed in claim 1, wherein the compound (c) is present in an amount of about 0.25 to about 2.0% by weight based on the weight of the compound (a) and the weight ratio of (c):(b) is in the range of about (0.25–2.0):1.

3. An oil-soluble sulfurized organic composition as claimed in claim 2, wherein the weight ratio of (c):(b) is about 1:1.

4. An oil-soluble sulfurized organic composition as claimed in claim 2, wherein the hindered organic amine (b) is present in an amount of from about 0.1 to about 20% by weight based on the weight of the oil-soluble sulfurized organic compound (a).

5. An oil-soluble sulfurized organic composition as claimed in claim 4, wherein the hindered organic amine (b) is present in an amount in the range of from about 0.25 to about 2% by weight based on the weight of the oil-soluble sulfurized organic compound (a).

6. An oil-soluble sulfurized organic composition as claimed in claim 5, wherein the hindered organic amine (b) has a solubility in the range of from about 0.01 parts by weight to about 10,000 parts by weight per 100 parts by weight of the oil-soluble sulfurized organic compound (a).

7. An oil-soluble sulfurized organic composition as claimed in claim 6, wherein the hindered organic amine is soluble in an amount of about 5.0 parts by weight to about 10,000 parts by weight per 100 parts by weight of the oil soluble sulfurized organic compound (a).

* * * * *